US007100225B1

(12) United States Patent
Bailey et al.

(10) Patent No.: US 7,100,225 B1
(45) Date of Patent: Sep. 5, 2006

(54) MODULAR SURGICAL PATIENT POSITIONER

(75) Inventors: James Bailey, Plainville, CT (US); Earl Cole, Prospect, CT (US)

(73) Assignee: IMP Inc., Plainville, CT (US)

( * ) Notice: Subject to any disclaimer, the term of this patent is extended or adjusted under 35 U.S.C. 154(b) by 0 days.

(21) Appl. No.: 11/097,626

(22) Filed: Apr. 4, 2005

(51) Int. Cl.
*A61G 13/12* (2006.01)

(52) U.S. Cl. ..... 5/621; 5/632; 5/723

(58) Field of Classification Search ..... 5/621, 5/722, 723, 657, 640, 632
See application file for complete search history.

(56) References Cited

U.S. PATENT DOCUMENTS

| | | | | | |
|---|---|---|---|---|---|
| 1,885,974 | A | * | 11/1932 | Winn | 5/723 |
| 2,548,547 | A | * | 4/1951 | Melrose | 5/723 |
| 3,521,310 | A | * | 7/1970 | Greenawalt | 5/636 |
| 3,763,507 | A | * | 10/1973 | Propst | 5/100 |
| 3,780,387 | A | * | 12/1973 | Propst | 5/692 |
| 3,787,909 | A | * | 1/1974 | Johnson | 52/578 |
| 3,848,278 | A | * | 11/1974 | Propst | 5/603 |
| RE32,734 | E | * | 8/1988 | McLeod | 5/722 |
| 4,876,755 | A | * | 10/1989 | Parrish | 297/284.3 |
| 5,566,409 | A | * | 10/1996 | Klearman | 5/723 |
| 5,568,664 | A | * | 10/1996 | Lin | 5/652 |
| 5,638,564 | A | * | 6/1997 | Greenawalt et al. | 5/636 |
| 5,867,849 | A | * | 2/1999 | Pontrello | 5/2.1 |
| 5,953,779 | A | * | 9/1999 | Schwartz | 5/722 |
| 6,622,727 | B1 | * | 9/2003 | Perry | 128/845 |
| 6,795,990 | B1 | * | 9/2004 | Hutchinson D. C. | 5/632 |
| 6,978,502 | B1 | * | 12/2005 | Calagui | 5/640 |

* cited by examiner

*Primary Examiner*—Robert G. Santos

(57) ABSTRACT

A modular surgical patient positioner unit consists of three perforated plastic boards arranged for interconnection together and for attachment to a hospital O.R. table. Two outer boards of similar length and width and a central board of similar width and greater length are employed. When employed with regular-sized patients, the three boards are arranged such that the widths thereof are in alignment. When employed with bariatric patients, the longer central board is rotated perpendicular the other two boards, to provide added width to support the bariatric patient.

1 Claim, 4 Drawing Sheets

MODULAR SURGICAL PATIENT POSITIONER

BACKGROUND OF THE INVENTION

Single and multi-piece patient positioner units in the form of an elongated plastic plate or board having a plurality of peg holes for receiving patient positioning pegs are currently used to support a patient during hip procedures.

The plastic board is generally co-extensive with the hospital O.R. table and is removably secured to the side rails thereof by means of clamps. Since bariatric patients of large body sizes require a larger positioner unit, several larger-sized patient positioner units must be kept in storage to accommodate the bariatric patients.

It would be both cost and space savings beneficial to provide a single patient positioner unit having facility to support both regular size surgical patients along with such bariatric patients.

One purpose of the instant invention is to provide a modular patient positioner unit having facility for supporting regular-sized as well as bariatric patients with only minor adjustments to the positioner unit.

SUMMARY OF THE INVENTION

A modular surgical patient positioner unit is disclosed having three perforated plastic rectangular boards arranged for interconnection together and for attachment to a hospital surgical hospital O.R. table. Two of the boards are of similar length and width while the third board is of similar width and approximately twice the length of each of the other two boards. When employed with regular-sized patients, the three boards are arranged in a first configuration such that the widths thereof are in alignment.

When employed with bariatric patients, the longer board is arranged intermediate the other two boards, with the length of the longer board arranged perpendicular to the width of the other two boards, to provide added width to support the bariatric patient.

DESCRIPTION OF THE PREFERRED EMBODIMENT

Figure 1:
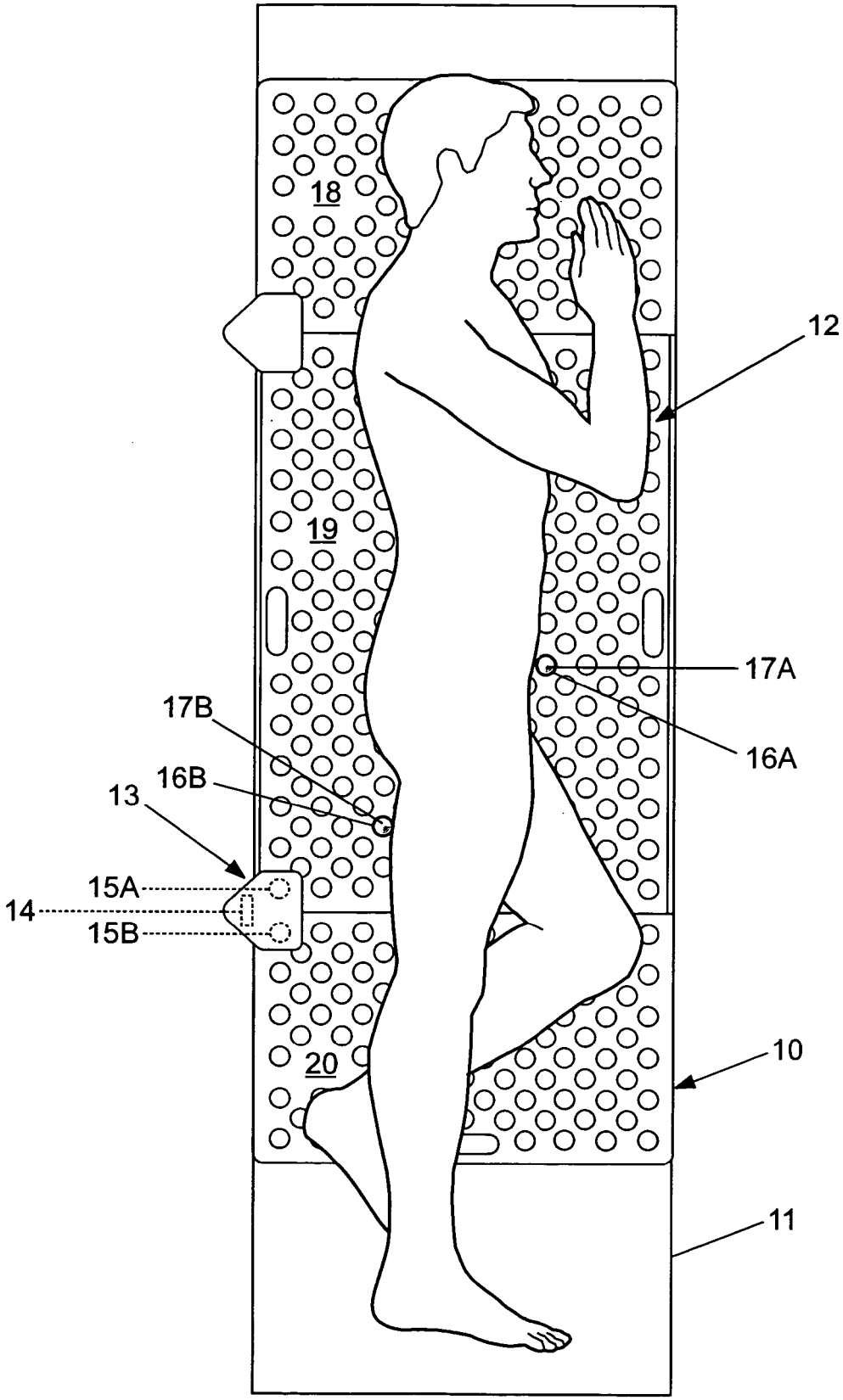
FIG. 1 is a top plan view of the modular surgical patient positioner unit of the invention arranged on a hospital surgical O.R. table to support a regular-sized patient.

FIG. 1 depicts the modular surgical patient positioner unit 10, hereafter "positioner unit", according to the invention attached to a hospital surgical bed 11 by means of posts 14 extending downward from a pair of plates or clamps 13, which clamps are also attached to the positioner unit by means of depending pins 15A, 15B, as indicated.

The positioner unit 10 is in the form of three plastic boards or plates 18, 19, 20 which are arranged beneath the top, middle and bottom portions of a regular-sized surgical patient 12 and are secured to each other by means of clamps 13 and include a plurality of apertures 16 for receiving patient positioning pegs 17A, 17B within the corresponding apertures 16A, 16B which serve to immobilize the patient's body during surgery.

Figure 2:
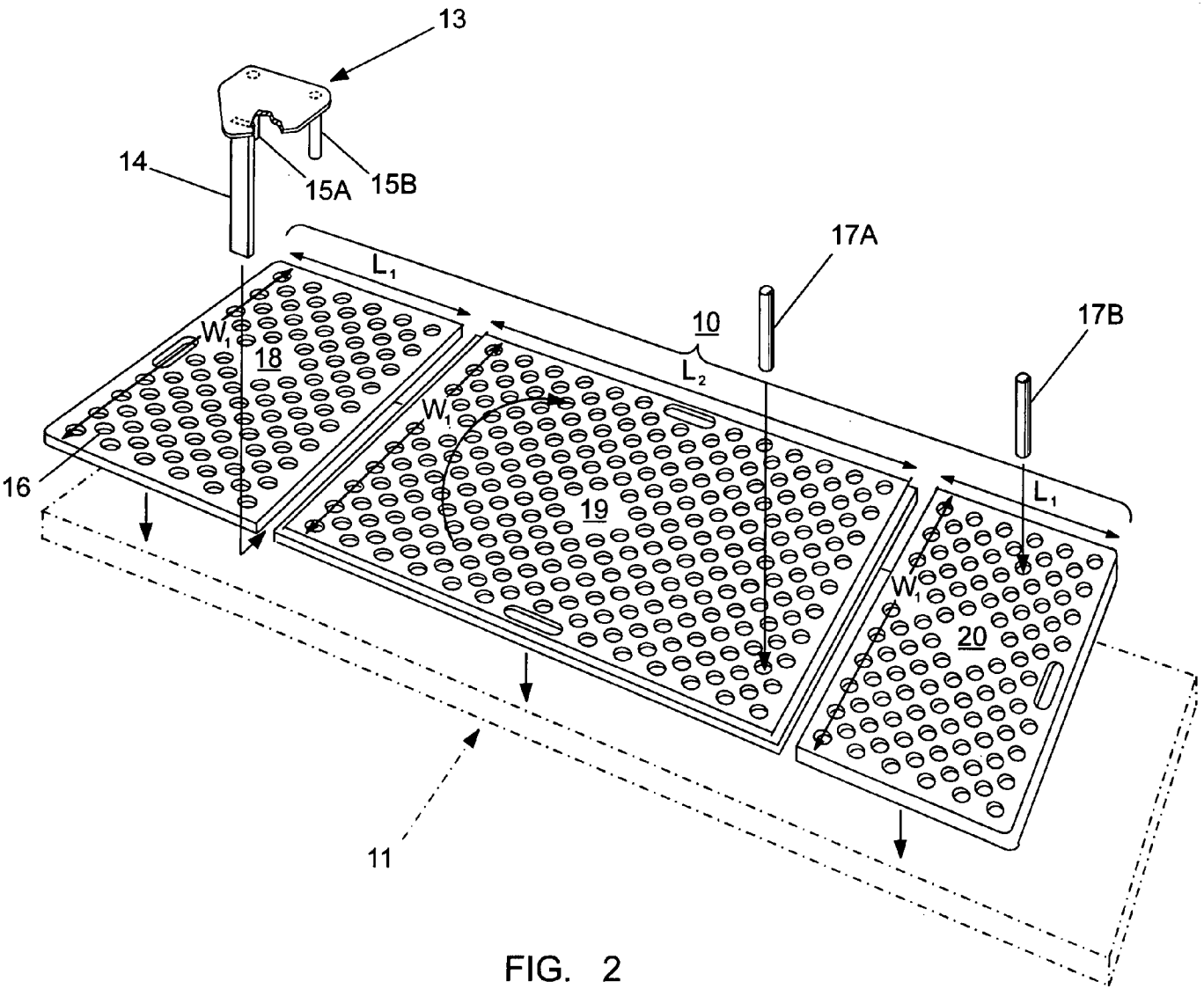
FIG. 2 is a top perspective view of the three boards of the surgical patient positioner unit of FIG. 1 prior to attaching to the hospital surgical bed.

The arrangement of the rectangular end boards 18, 20 and rectangular central board 19 of the positoner unit 10 relative to the hospital O.R. table 11, indicated in phantom, is best seen by referring now to FIG. 2.

A single clamp 13 is shown on one side of the hospital O.R. table 11 of FIG. 1 to detail the downwardly extending post 14 for attaching with the hospital surgical bed 11 and the depending pins 15A, 15B used for positioning within the apertures 16 to secure the end boards 18, 20 and central board 19 together to form the positioner unit 10. A pair of positioner pegs 17A, 17B arranged for being received within apertures 16 is shown for purposes described earlier.

Although a pair of such positioner pegs 17A, 17B is shown, it is understood that a plurality of such pegs are often employed. In further accordance with the invention, end boards 18, 20 are shown having a width W1 and a length L1 while central board 19 is shown having a common width W1 and a length L2, which is approximately twice that of L1. It is noted that the length L2 can be of various sizes in accordance with the patient's needs. The provision of a central board 20 having a greater length is best understood by referring now to FIGS. 3 and 4.

Figure 3:
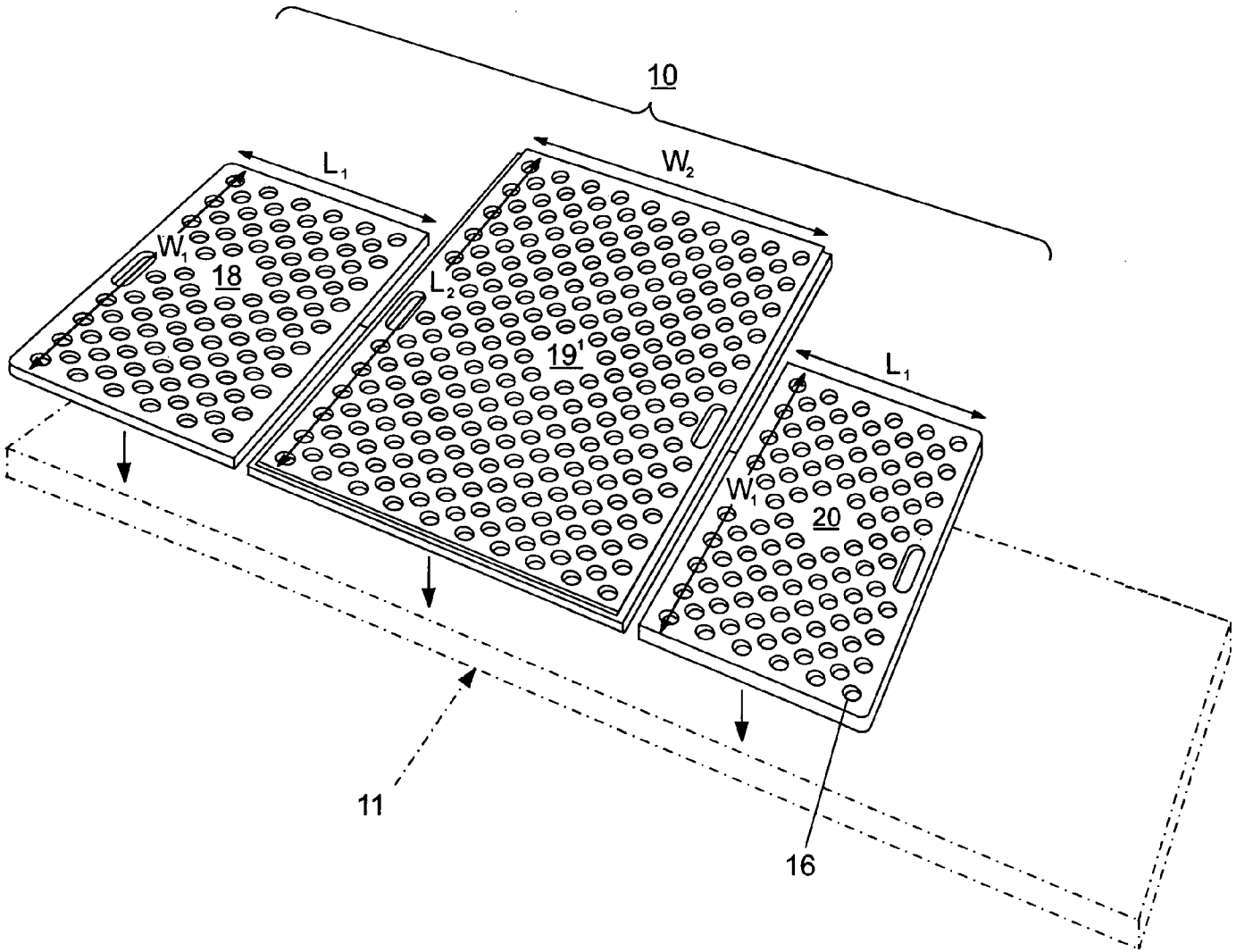
FIG. 3 is a top perspective view of the three boards of the surgical patient positioner unit of the invention prior to attaching to the hospital surgical bed to support bariatric patient.

In FIG. 3 the end boards 18, 20 within the positioner unit 10 are arranged in a similar manner as in FIG. 2 with the lengths L1 and widths W1 positioned relative to the hospital O.R. table 11 as shown in FIG. 2.

The central board 19 of FIG. 2 is rotated in the counter-clockwise direction, as indicated, and the central board 19' is depicted in FIG. 3 such that the length L2 is of the central board 19' is now perpendicular to the lengths L1 of the end boards 18, 20.

Figure 4:
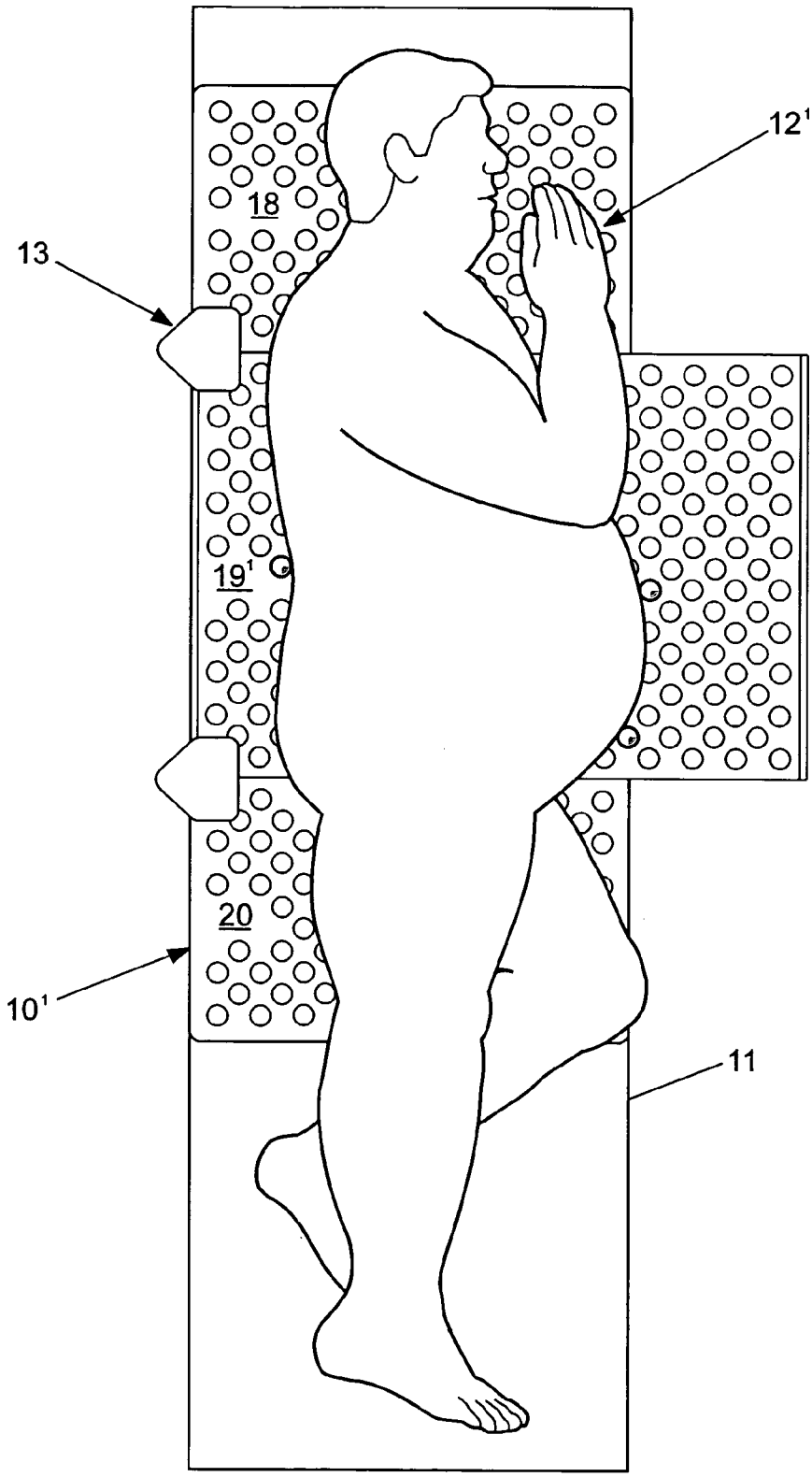
FIG. 4 is a top plan view of the modular surgical patient positioner unit of the invention arranged on a hospital O.R. table to support a bariatric patient.

As shown in FIG. 4, a bariatric patient 12' is positioned on the positioner unit 10' that is attached to the hospital O.R. table 11 by means of a pair of clamps 13 in a similar position as shown earlier. The end boards 18, 20 are arranged to support the top and bottom portions of bariatric patient 12' while the central board 19' supports the middle portion thereto.

A modular three-board surgical patient positioner unit has been shown to facilitate both a regular-sized as well as a bariatric patient by merely rotating the central board to provide additional support.

What is claimed is:

1. A method for providing support to a patient on a hospital surgical bed comprising the steps of:

arranging a first rectangular positioner board at one end of the hospital surgical bed, said first positioner board having a first width dimension and a first length dimension;

arranging a second rectangular positioner board at an opposite end of said hospital surgical bed, said second positioner board having a second width dimension and a second length dimension;

arranging a third rectangular positioner board intermediate said first and second positioner boards, said third positioner board having a third width dimension and a third length dimension, said third width dimension being equal to said first width dimension and said second width dimension, said third length dimension being greater than said first length dimension and said second length dimension;

to accommodate a surgical patient of a first body size; and arranging said third width dimension of said third board perpendicular to said first width dimension of said first positioner board and to said second width dimension to accommodate a patient of a second body size greater than said first body size.

* * * * *